United States Patent [19]

Dewolf et al.

[11] 4,365,246

[45] Dec. 21, 1982

[54] ROSARY DEVICE

[75] Inventors: Lowell E. Dewolf, 666 San Mario Dr., Solana Beach, Calif. 92075; James J. Scrudato, 2796 N. Dalenhurst Pl., Simi Valley, Calif. 83065; Robert S. Wallace, 823 S. Longwood Ave., Los Angeles, Calif. 90005

[73] Assignees: Lowell E. Dewolf; James J. Scrudato; Robert S. Wallace, all of Solana Beach, Calif.

[21] Appl. No.: 265,042

[22] Filed: May 18, 1981

[51] Int. Cl.[3] ..... G08B 5/36

[52] U.S. Cl. ..... 340/802; 315/133; 340/87; 340/782

[58] Field of Search ..... 340/87, 782, 784, 802; 368/10, 278; 315/133

[56] References Cited

U.S. PATENT DOCUMENTS

| | | | |
|---|---|---|---|
| D. 173,604 | 12/1954 | Beaumon . | |
| D. 242,644 | 12/1976 | Spruck . | |
| 961,571 | 6/1910 | Adams | 368/278 X |
| 1,774,059 | 8/1930 | Hennegan . | |
| 1,938,727 | 12/1933 | Tammany . | |
| 2,213,516 | 9/1940 | Beehan . | |
| 2,461,130 | 2/1949 | Szaj . | |
| 2,759,096 | 8/1956 | Caissie . | |
| 2,912,770 | 11/1959 | Goddard . | |
| 3,732,560 | 5/1973 | Harden et al. . | |
| 3,737,647 | 6/1973 | Gomi . | |
| 3,806,911 | 4/1974 | Pripusich | 340/802 |
| 4,079,369 | 3/1978 | Fukumoto | 340/784 X |
| 4,164,008 | 8/1979 | Miller et al. . | |
| 4,170,036 | 10/1979 | Sussel . | |
| 4,199,758 | 4/1980 | Wilhelm et al. | 340/782 X |
| 4,254,451 | 3/1981 | Cochran . | |
| 4,264,845 | 4/1981 | Bednarz . | |
| 4,298,917 | 11/1981 | Ware . | |
| 4,308,572 | 12/1981 | Davidson et al. . | |

*Primary Examiner*—David L. Trafton

*Attorney, Agent, or Firm*—William W. Haefliger

[57] ABSTRACT

A Rosary device comprises a hand held casing having electrically energizable elements in a pattern, the elements having different characteristics corresponding to different Rosary prayers.

12 Claims, 12 Drawing Figures

ROSARY DEVICE

BACKGROUND OF THE INVENTION

This invention relates generally to rosaries, and more specifically concerns a rosary device which is electromechanical, and is well adapted to visually indicate the successive steps (corresponding to beads) of rosary prayers, in response to simple manual activation.

There is need for a simple rosary device adapted to manual activation, with the following characteristics:

(a) It may be held in one hand, and activated to proceed through the prayer steps;

(b) it visually indicates the prayer steps;

(c) it may be used by injured or sick persons who cannot manipulate rosary beads;

(d) it can be mounted in several ways, as for example on a steering wheel of an automobile so as to be used while driving.

SUMMARY OF THE INVENTION

It is a major object of the invention to provide a rosary device which will meet the above need.

Basically, the device comprises:

(a) a casing sized to be hand held, the casing having wall structure, (b) electrically energizable means having terminals proximate said wall structure, said terminals defining a loop, (c) and control means for controllably electrically energizing said (b) means so that said terminals are successively and controllably illuminated, (d) certain of said terminals having a first characteristic indicative of a Hail Mary prayer, and others of said terminals having a second characteristic indicative of an Our Father prayer.

As will appear, the energizable means may comprise LEDs in a matrix, and defining the illuminable terminals; the device wall structure may include front and rear walls, with a generally circular side wall, all of which are sized to hold in one hand by the user, with the terminals proximate the front wall; a support means may be employed in the casing, as for example to enable its attachment to the steering wheel of an automobile; and the illuminable terminals may be arranged in a heart shaped loop, as will appear.

These and other objects and advantages of the invention, as well as the details of an illustrative embodiment, will be more fully understood from the following description and drawings, in which:

DRAWING DESCRIPTION

Figure 1:
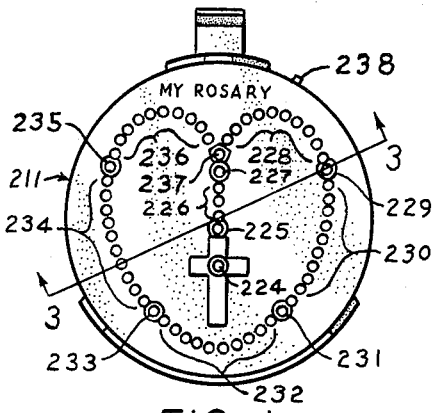
FIG. 1 is a front elevation showing a rosary device incorporating the invention.
Figure 3:
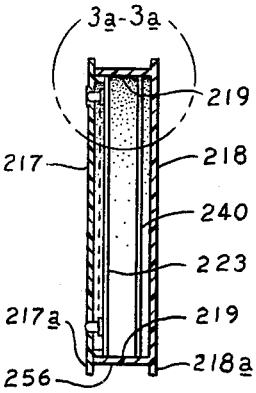
FIG. 3 is a section taken on lines 3—3 of FIG. 1.
Figure 2:
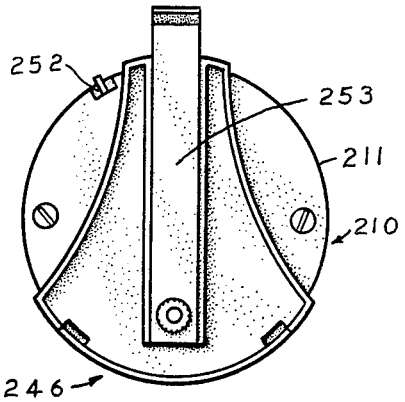
FIG. 2 is a rear elevation of the FIG. 1 device.
Figure 4:
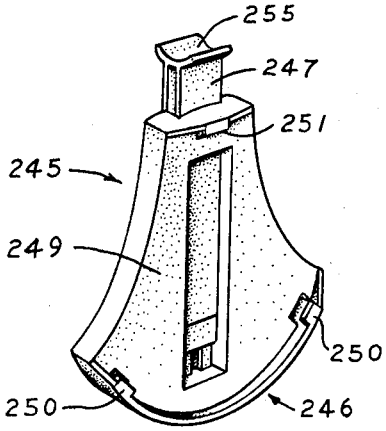
Figure 5:
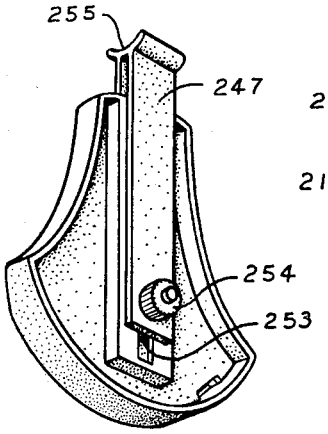
Figure 6:
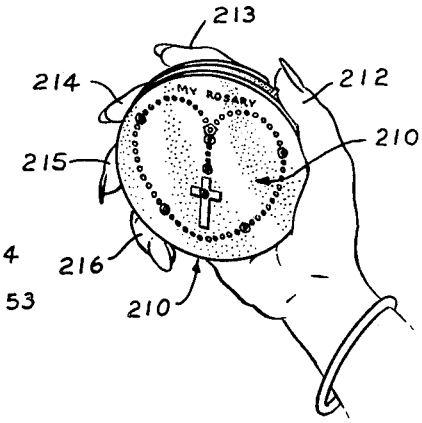
Figure 7:
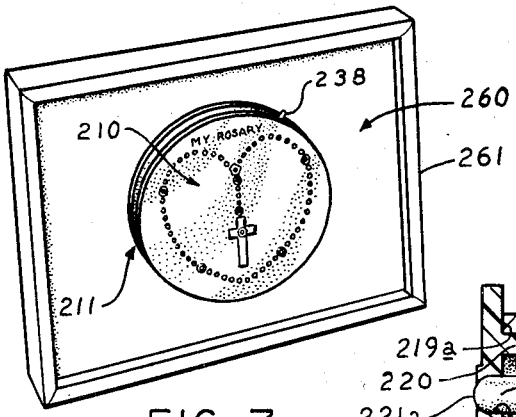
Figure 3A:
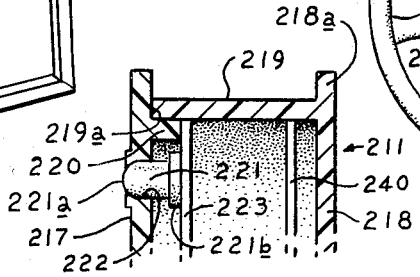
Figure 8:
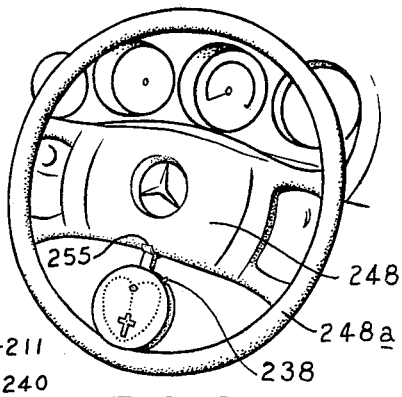
Figure 9:
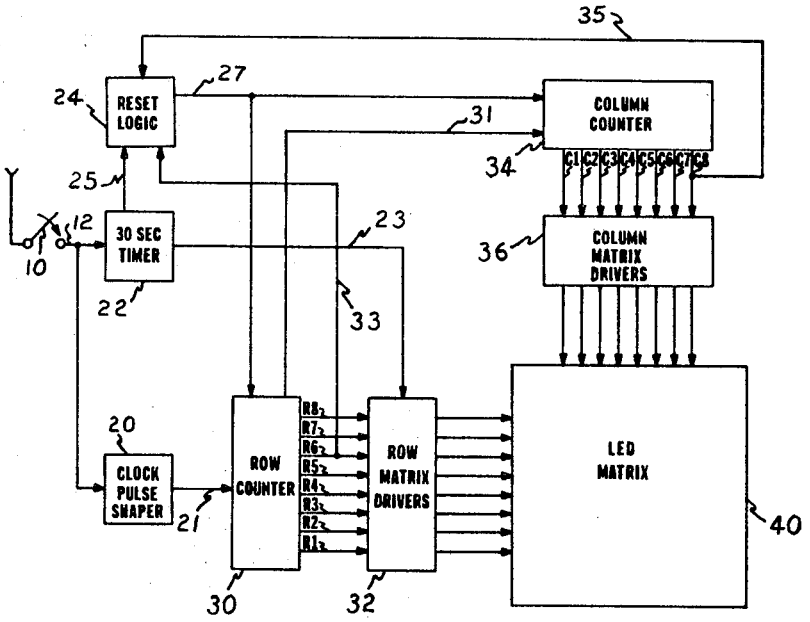
Figure 10:
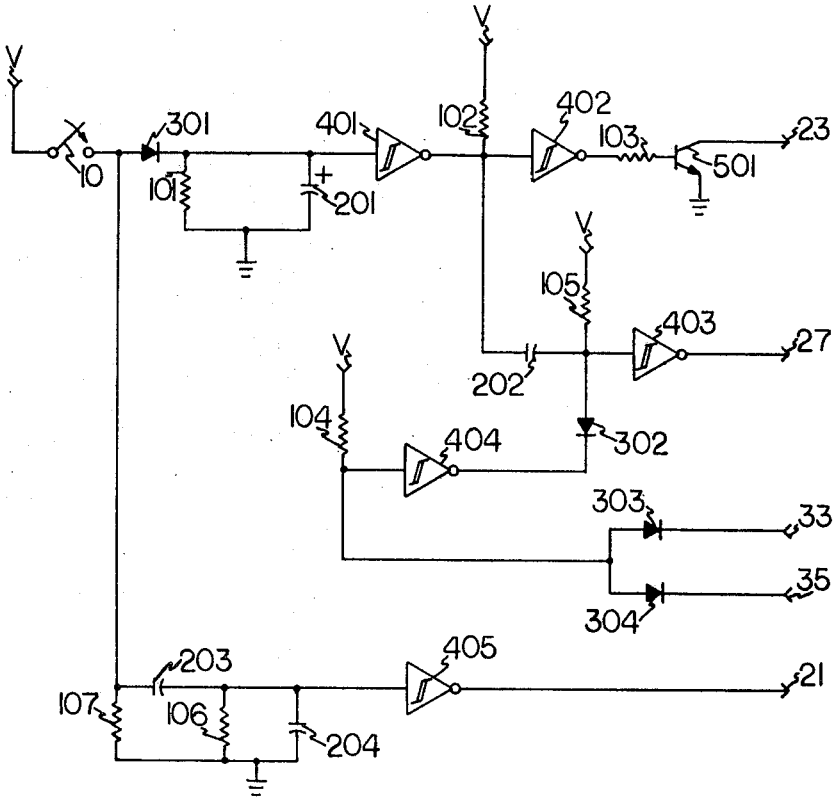
Figure 11:
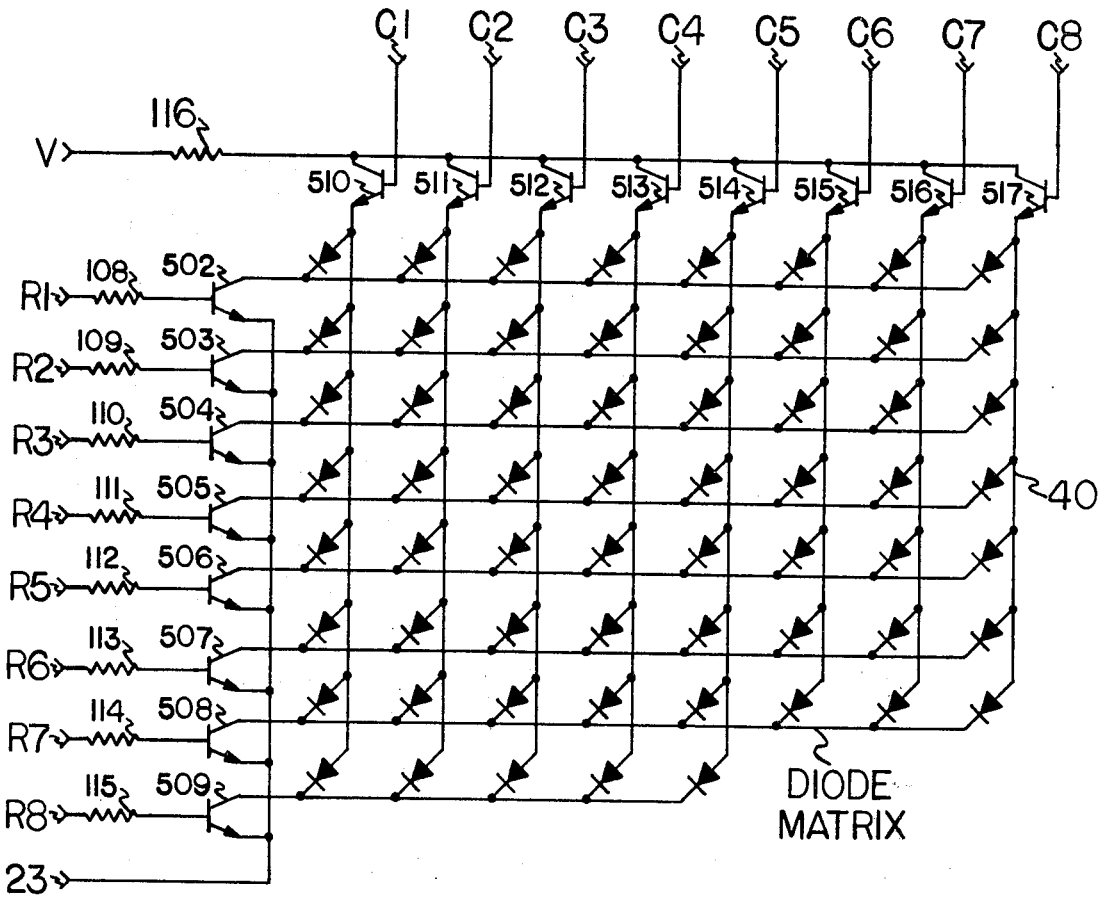

FIG. 3*a* is a fragmentary section taken on lines 3*a*—3*a* of FIG. 3;

FIG. 4 is a perspective view showing support means for the FIG. 1 device;

FIG. 5 is a perspective view showing the opposite side of the FIG. 4 support means;

FIG. 6 is a view showing hand holding of the FIG. 1 device;

FIG. 7 is a perspective view of a modified support for the FIG. 1 device;

FIG. 8 is a frontal view showing the FIG. 1 device and the FIG. 4 support attached to an automobile steering wheel;

FIG. 9 is a block diagram showing control circuitry for LEDs;

FIG. 10 is a more detailed circuit usable for reset logic, timer and pulse shaper elements of FIG. 9; and FIG. 11 is a more detailed circuit diagram of diode and transistor elements in the matrix shown in FIG. 9.

DETAILED DESCRIPTION

In FIGS. 1–3 and 3*a*, the Rosary device 210 comprises a casing 211 sized to be hand-held, as in FIG. 6, with thumb and fingers 212–216 extending about the generally circular casing periphery. The casing has wall structure that may for example include generally parallel front and rear walls 217 and 218, and side wall means extending between and joining the wall 217 and 218. The side wall means may comprise a cylindrical side wall 219 integral with wall 218, and abutting the inner side of front wall 217 at 219*a*; also, wall 219 may seat on or interfit with a stub wall 220 integral with front wall 217. Suitable adhesive may join wall 219 to walls 217 and 220.

Associated with the casing 211 is electrically energizable means having terminals proximate the wall structure (as for example wall 217) the terminals defining a loop. In the example, the electrically energizable means includes LEDs (see LED 221 in FIG. 3*a*) having terminals in the form of ends 221*a* exposed to the front side of wall 217, for viewing. For example, that wall may contain openings 222 into which the LEDs fit. The bases 221*b* of the LEDs may be carried on a front circuit board 223 within the casing, and extending parallel to wall 217, as shown.

Referring to FIGS. 1 and 6, the LED terminals are arranged in a heart shaped loop having a cusp defined by LED 237.

Certain of the LED terminals have a first characteristics indicative of a "Hail Mary" prayer to be spoken. See in this regard the groups 228, 230, 232, 234 and 236 of ten LEDs each arranged in the heart shaped loop, as shown. An additional group 226 of three "Hail Mary" LEDs is below the cusp. Others of the terminals have a second characteristic indicative of an "Our Father" prayer to be recited. See in this regard the LEDS 225, 227, 229, 231, 233 and 235 located as shown. The "Our Father" terminals may be relatively larger (i.e. have larger end terminals) than the "Hail Mary" LEDs, for example; or they may have color different from such LEDs, when energized, these being examples of the different characteristic referred to. Additional LEDs are shown at 224, (Sign of the Cross and Apostle's Creed); 225 (Our Father); and 237 (Hail Holy Queen).

In use, the user presses a switch button 238 at the periphery of the casing each time he completes a prayer, and the LEDs are successively illuminated as follows: first 224, next 225, then each of those in group 226 in sequence, then 227, then each of those in group 228, then 229, and on around the loop to 236, and finally 237. The switch 238 may be considered a part of control means for controllably energizing the LEDs so that their terminals are successively and controllably illuminated, as described. The "Hail Mary," prayer, is spoken each time one of the LEDs in groups 226, 228, 230, 232, 234 and 236 is illuminated; and the "Our Father" prayer is spoken each time one of the LEDs 225, 227, 229, 231, 233 and 235 is illuminated. Additional prayers, as noted are spoken when the remaining LEDs are illuminated. The control means also includes electronic circuitry, to be described, which may be carried on a second circuit board 240 located within the casing, closer to rear wall 218, as shown in FIGS. 3 and 3*a*.

Also provided is support means on the casing to support the device for observation of the terminals, as referred to. One such support means comprises an adjustable bracket engageable with automobile steering wheel structure, to removably attach the device to the latter, so that the user may recite his rosary paryers while driving. See for example the bracket 245 of FIGS. 4, 5 and 8, having a clip portion 246 enabling removably attachment to the casing 211, and an arm 247 enabling removably attachment to the cross-piece 248 of steering wheel 248*a*. Clip portion 246 is shown to include a base 249 adapted to extend adjacent rear wall 218, and tabs 250 adapted to fit over a rear wall peripheral flange 218*a*. A third tab 251 fits over the same flange, after passage of that tab through a notch 252 in that flange, and rotation of the base about central axis 253 (see FIG. 2). Thus, the base is attached to the rear wall 218. The arm 247 has tongue and groove connection to the base portion at 253, so as to slide generally diametrically relative thereto. A set screw and knob 254 tightens the arm to the base in a selected fixed position. A concave head 255 on the end of the arm interfits the steering wheel cross-piece as shown in FIG. 8. At the same time, the channel 256 formed between front and rear wall peripheral flanges 217*a* and 218*a*, together with side wall 219, interfits the steering wheel inner rim, as shown in FIG. 8. Thus, when the interfits are accomplished, and knob 254 tightened, the device 10 is securely yet removably attached, in selected position to the steering wheel, enabling the user to pray with his Rosary, while driving. The support means shown in FIG. 7 comprises a plaque 260, centrally mounting the casing 211, and framed at 261.

An LED matrix 40 is shown in FIG. 11. There are 61 diodes illustrated, each representing one LED in the rosary. Row transistors 502–509 have collectors respectively connected as shown with rows of diodes, and their bases are energizable via input leads designated at $R_1$–$R_8$, in which resistors 108–115 are respectively connected. The transistors have their emitters connected with a lead represented at 23. Thus, when any lead such as $R_5$ is energized, the associated transistor, as at 506, is rendered conductive, and the row of diodes in the matrix connected with the collector of that transistor is enabled. Column transistors 510–517 have their collectors connected with a lead supplied with voltage V, via resistor 116. Their bases are energizable via input leads designated at $C_1$–$C_8$, and their emitters are connected with column leads which are in turn connected with columns of the diodes, as shown. Thus, if the bases of transistors 506 and 513 are both energized, the one diode at the intersection of the associated row and column is energized. The circuitry driving the input leads $R_1$–$R_8$ and $C_1$–$C_8$ is designed to sequentially energized the diodes. See for example the FIG. 9 row counter 30 and row matrix drivers 32, and the FIG. 9 column counter 34 and the column matrix drivers 36, these being connected as shown with the switch 10, 30 second timer 22, clock pulse shaper 20, and reset logic 24.

In FIG. 10, the timer circuitry is shown in greater detail at 101, 301, 201, 401, 402, 103, and 501. Elements of the reset logic appear at 403, 302, 104, 404, 102, 105 and 202, 303 and 304. Elements of the pulse shaper appear at 203, 107, 106, 204 and 405.

In operation, momentarily closing of switch 10 activates the timer 22 and clock pulse shaper 20. The timer enables the row drivers 32. Counter 30 is driven by the pulses at 21 of clock 20, and effects successive energization of the row inputs $R_1$–$R_8$ in the diode matrix, for each column input $C_1$–$C_8$.

Alternatively, the diodes in the matrix 40 can be considered to represent buzzers or other audio transmitters, so that the user can determine the sequence of prayer "stations," without viewing the front of the device.

More specifically, and referring to FIG. 10, when spring loaded switch 10 is momentarily closed, capacitor 201 charges to voltage V instantaneously through diode 301. This causes the output of Schmitt trigger 401 to switch from voltage V to ground. 401 is now in the "ON" state, and will remain ON for approximately 30 seconds. The latter is the time it will take 201 to discharge through resistor 101, at which time the input voltage at 401 will reach the "OFF" threshold input voltage, and 401 is output will switch back to voltage "V".

Two events begin simultaneously when 401 switches from V to ground. The falling edge of the output of 401 is capacitor coupled through 202, which discharges instantaneously toward ground and then begins to charge back to voltage V through resistor 105. The output of Schmitt trigger 403 line 27 switches during this time from ground to voltage V until capacitor 202 reaches the "ON" threshold input voltage of 403, causing 403 to switch back to ground. The output pulse 27 generated by 202, 105, and 403 initializes the row and column counters 30 and 34 respectively to state 1 in the count sequence. The 30 second pulse from 401 also drive the input to Schmitt trigger 402, causing 402's output to switch from ground to voltage "V". Current then flows to the base of transistor 501 through resistor 103. Transistor 501 begins to conduct current through its collector 23 and saturates, providing a ground path for the LED selected by the row and column counters 30 and 34. Also, when switch 10 is momentarily closed, capacitor 203 and resistors 106 and 107 provide a differentiation network. The voltage V will be present at the input of 405 instantaneously and then begin to decay toward ground. Resistor 107 provides a discharge path for 203 when switch 10 opens. Capacitor 204 provides debouncing of switch 10 contacts. The output of 405 will switch from voltage V to ground and remain at ground potential until capacitor 203 has charged up sufficiently to allow the input voltage of 405 to drop below the "ON" state threshold.

The output pulse of 405 is the clock pulse to row counter 30. Each time switch 10 is closed after the thirty second timer has been activated, the row counter 30 will advance by one. Each advance causes the next LED in the sequence to become lighted. After row counter 30 quantizes, it generates a clock pulse on output 31 which advances the column counter 34 by one, causing the next column of LEDs to be selected. Now the row counter 30 will repeat its count until it quantizes and clocks the column counter to column 3, etc. When the row counter line R6 is at voltage V and column counter line C8 is at voltage V, diodes 303 and 304 both become non-conductive allowing resistor 104 to pull the input of 404 to voltage V. The output of Schmitt trigger 404 falls from V ground through diode 302. The output of Schmitt trigger 403 switches off and line 27 goes to V causing the counters to reset and start at the beginning of the cycle. The counter will count 61 clock pulses before resetting occurs. Once counters 30 and 34 are reset diodes 303 and 304 are once again conducting, causing 404 to switch OFF. Resistor 105 now pulls the input of 403 to V and 403 switches toward ground which removes the reset on line 27. Counters are not initialized to begin the sequence again.

If switch 10 is closed momentarily during the 30 second interval, the counters are clocked and the timer is retriggered for a new 30 second interval. If switch 10 is closed after the 30 seconds has timed out, the sequence is initialized to the beginning. The 30 second timer will allow the diode matrix 40 to have a completed circuit 20 the LEDs can conduct current through resistor 116 the selected row and column transistor and transistor 501 to ground. To conserve power when the circuit is not in use, the diode matrix 40 turned off by breaking the ground path at 23.

We claim:

1. A Rosary device, comprising (a) a casing sized to be hand held, the casing having wall structure, (b) electrically energizable means having terminals proximate said wall structure, said terminals defining a loop, (c) and control means for controllably electrically energizing said (b) means so that said terminals are successively and controllably illuminated, (d) certain of said terminals having a first characteristic indicative of a Hail Mary prayer, and others of said terminals having a second characteristic indicative of an Our Father prayer.

2. The device of claim 1 wherein said (b) means includes LEDs defining at least some of said terminals.

3. The device of claim 1 wherein said other terminals are larger than said first terminals.

4. The device of claim 1 wherein said wall structure includes front and rear walls, and side walls means extending between said front and rear walls, said terminals located proximate said front wall to be viewable when said front wall is observed, and said control means includes a switch proximate said wall structure.

5. The device of claim 4 including support means on said casing to support the device for observation of said terminals.

6. The device of claim 5 wherein said support means includes an adjustable bracket engageable with automobile steering wheel structure to removably attach the device thereto.

7. The device of claim 6 wherein said wall structure includes flange means spaced from said bracket and also engageable with said steering wheel structure, whereby said flange means and said bracket coact to removably attach the device to said steering wheel structure.

8. The device of claim 6 in combination with said steering wheel structure to which the device is removably attached.

9. The device of claim 5 wherein said support means comprises a plaque to which the device is attached.

10. The device of claim 1 wherein said terminals are arranged in a heart shaped loop having a cusp, one of said terminals and a crucifix symbol on the wall structure being located within the heart shaped loop, and spaced from said cusp.

11. The device of claim 2 wherein said control means includes a diode and transistor matrix electrically connected with said LEDs to sequentially electrically energize said LEDs.

12. The device of claim 10 wherein said control means includes a manually operable switch, a diode and transistor matrix, and circuit means to effect sequential energization of diodes in the matrix for pre-determined time intervals, in response to repeated operation of the switch.

* * * * *